US008899435B1

(12) United States Patent
Reder et al.

(10) Patent No.: US 8,899,435 B1
(45) Date of Patent: Dec. 2, 2014

(54) CUP ASSEMBLY

(71) Applicants: Paul Reder, Zephyr Cove, NV (US); Brian Kalisz, Zephyr Cove, NV (US); Lucas Kalisz, Stateline, NV (US)

(72) Inventors: Paul Reder, Zephyr Cove, NV (US); Brian Kalisz, Zephyr Cove, NV (US); Lucas Kalisz, Stateline, NV (US)

( * ) Notice: Subject to any disclaimer, the term of this patent is extended or adjusted under 35 U.S.C. 154(b) by 0 days.

(21) Appl. No.: 14/169,887

(22) Filed: Jan. 31, 2014

Related U.S. Application Data

(60) Provisional application No. 61/822,509, filed on May 13, 2013.

(51) Int. Cl.
*A47G 19/22* (2006.01)
*B65D 21/02* (2006.01)

(52) U.S. Cl.
CPC ..... *A47G 19/2205* (2013.01); *B65D 21/0234* (2013.01); *B65D 21/0228* (2013.01)
USPC ..... 220/23.86; 206/507; 29/428; 220/23.83; 220/630

(58) Field of Classification Search
CPC ... A47G 19/23; A47G 19/02; B65D 21/0228; B65D 21/0209; B65D 21/0234; B65D 21/0233
USPC ..... 220/630, 628, 625, 23.86, 23.83, 4.27, 220/4.26, 23.89, 505, 629, 636, 647, 648, 220/649; 206/507, 505, 519, 515, 217, 564, 206/562, 514; 248/146, 127; 215/395, 386; 229/904, 400
See application file for complete search history.

(56) References Cited

U.S. PATENT DOCUMENTS

| | | | | |
|---|---|---|---|---|
| 2,868,411 | A * | 1/1959 | Kesselman | 220/737 |
| 4,854,468 | A * | 8/1989 | Dahlquist et al. | 220/737 |
| 6,562,270 | B1 * | 5/2003 | Gannon et al. | 264/239 |

FOREIGN PATENT DOCUMENTS

| | | | | |
|---|---|---|---|---|
| GB | 2406556 | A * | 4/2005 | B65D 21/0228 |
| WO | WO 03000560 | A1 * | 12/2003 | B65D 21/0228 |
| WO | WO 2010034340 | A1 * | 4/2010 | B65D 21/0228 |

* cited by examiner

*Primary Examiner* — Robert J Hicks
(74) *Attorney, Agent, or Firm* — Heisler & Associates

(57) ABSTRACT

A large cup and small cup are provided which are attachable together. With an upright attachment the large cup nests within a reservoir of the small cup. With an inverted attachment, the small cup has a base which can friction fit against a lower end of the large cup. The small cup includes structures such as a skirt and shelf which can exhibit a friction fit with a foot on the lower end of the large cup to facilitate the inverted attachment of the small cup to the large cup. A recess in the base of the small cup exhibits a friction fit with the foot to facilitate upright attachment when the large cup is nested into the small cup. In an alternative embodiment a fastener is provided including posts and slots in the small cup and large cup to couple the cups together when nested together.

20 Claims, 4 Drawing Sheets

CUP ASSEMBLY

CROSS-REFERENCE TO RELATED APPLICATIONS

This application claims benefit under Title 35, United States Code §119(e) of U.S. Provisional Application No. 61/822,509 filed on May 13, 2013.

FIELD OF THE INVENTION

The following invention relates to cups such as those utilized for drinking beverages and for containing liquids and other miscellaneous items. More particularly, this invention relates to sets of cups which can attach together in a variety of different ways.

BACKGROUND OF THE INVENTION

At parties where beverages are being served, it is often desirable to move about while carrying a beverage. It is generally desirable to have one hand free with the other hand available to carry a cup or other beverage container. The free hand is thus available for a variety of different uses including carrying food, shaking hands, and a multitude of other uses.

In some instances, it is desirable to enjoy a mixed beverage with the two components of the mixed beverage beneficially kept separate for at least some period of time. The two components are then typically combined together before drinking. As an alternative, the two beverage components could be enjoyed separately rather than being mixed together. In other instances it is desirable to have both snacks and a beverage.

One method for enjoying such a mixed beverage (or beverage and snacks) is to merely carry two cups or other beverage containers. However, then the user does not have a hand remaining free. Because the two beverage components are typically combined together, the user only needs two hands available to hold the two containers for a short period of time, before drink component combination, but then the remaining empty cup must be somehow disposed of if one of the hands is to be freed. Accordingly, a need exists for being able to attach one beverage container to another beverage container when only one beverage container is required, but which containers are detachable from each other so that they can hold separate beverages when desired, such as two components of a mixed beverage.

One example of such a beverage mixture situation is where a primary beverage is being carried by the individual and then someone offers a "shot" of some other beverage to the individual. While the "shot" of the additional beverage could be added directly into the container carrying the first beverage, this removes control from the individual carrying the cup as to how and when and in what proportions to mix the two components together. Rather, control is given to the individual providing the "shot." Utilizing two separate full size containers requires that the individual utilize both hands, leaving no hands available for other uses. Accordingly, a need exists for beverage containers which can be held to each other while one of the containers can still be used and a second beverage container is removably attachable from the first beverage container when desired, such as for receiving a "shot" to be enjoyed separately or through later mixing with a first beverage in the first container.

SUMMARY OF THE INVENTION

With this invention a cup assembly is provided with two separate assemblies removably attachable to each other, and each assembly able to carry a liquid (or non-liquid, such as a snack food) therein. In a preferred embodiment the first container is a standard plastic party cup. Such a standard plastic party cup typically has a flat circular lower end with a tapering side wall tapering up from the lower end to a rim. The rim is typically circular and has a diameter slightly greater than a diameter of the lower end. The rim could alternatively have some other shape. Typically, a large number of cups are provided with a similar size and shape so that they can nest together and efficiently utilize space when stored and not in use. The interior reservoir of the typical plastic party cup is open at the rim and open down to the lower end.

With this invention the typical prior art plastic party cup is modified in one or more ways. First, the cup or other container is modified to include one half of a fastener for fastening to a second short container. In one embodiment this fastener is in the form of a threaded exterior on the side wall of the first container, just above the lower end.

A short container, such as a short cup, is provided which preferably has a circular base sized similar to the lower end of the first container, and a side tapering up from the bottom to a lip opposite the base. A height of the side is less than a height of the first container from the lower end to the rim. Typically, this height is approximately one-third of the height of the first container. The short container has part of a fastener on an interior of the side just above the base. The base has a size similar to the lower end. Thus, the short container can be nested with its base adjacent the lower end and outside of the side wall of the first container and engage with the lower end of the first container. The short container is thus removably attachable to the first container.

The first container is primarily utilized by the individual. Should a second beverage be offered, such as a "shot," the user disconnects the short container relative to the first container. The short container can then be removed from the first container and is available to contain the "shot" or other second beverage. Similarly, if a snack food is offered (e.g. peanuts), the second container can be removed from the first container and is available to carry the snack.

The individual holds the short container in one hand and the first container in the other hand. The individual can then combine at least a portion of the "shot" or other beverage in the short container with the beverage contained within the first container when desired by the individual. The short container can then be reattached to the first container and the mixed beverage can be enjoyed at the individual's leisure while keeping a second hand available for other uses.

By configuring the container of the lower end complemental with the contour of the base, the second container can attach to the first container in a second way. The second container is inverted and the base is brought into contact with the lower end where structures such as a foot and a skirt can press together and friction hold the first container to the second container in an inverted attachment.

Various forms of fasteners could also be utilized to hold the second container to the first container, most preferably in a nesting fashion. For instance, magnets could be utilized, suction cups, snaps, threads, friction fit complemental surfaces, or other fasteners, so as to removably hold the second container to the first container.

OBJECTS OF THE INVENTION

Accordingly, a primary object of the present invention is to provide a set of two or more cups which can be removably attached together for use either separately or together.

Another object of the present invention is to provide a set of two or more cups which can attach together in at least two different ways to provide different functionalities.

Another object of the present invention is to provide an assembly of cups which are of different sizes and which can removably attach to each other.

Another object of the present invention is to provide an assembly of cups which are readily formed utilizing known cup forming techniques for disposable cups.

Another object of the present invention is to provide a method for attaching a set of two or more cups together in a removable fashion so that the cups can either be attached together or separated.

Another object of the present invention is to provide a method for enjoying two separate beverages or other food items while still often having one hand free.

Other further objects of the present invention will become apparent from a careful reading of the included drawing figures, the claims and detailed description of the invention.

DESCRIPTION OF THE PREFERRED EMBODIMENT

Figure 1:
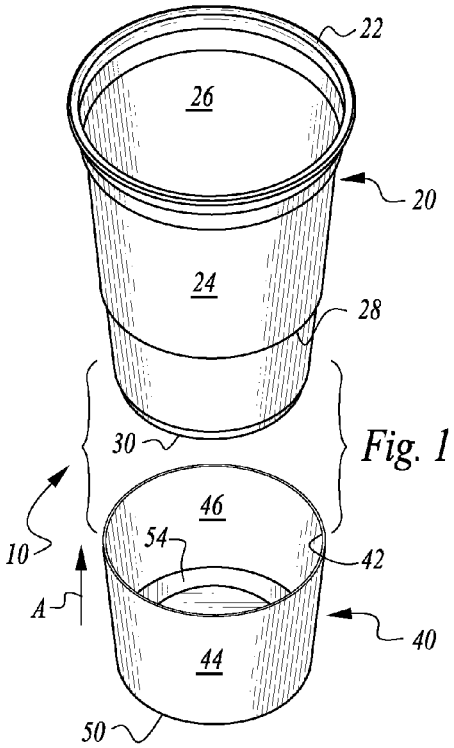
FIG. 1 is a perspective view of a first embodiment of the cup assembly of this invention with a second small cup exploded away from a first large cup.

Referring to the drawings, wherein like reference numerals represent like parts throughout the various drawing figures, reference numeral 10 is directed to an assembly of cups 20, 40 (FIGS. 1-4). The cups 20, 40 can attach together two different ways including nesting together (FIG. 1) for an upright attachment and stacking in a non-nesting fashion (FIG. 3) for an inverted attachment. The cups 20, 40 can thus be either used separately or stored together when not in use separately.

Figure 2:
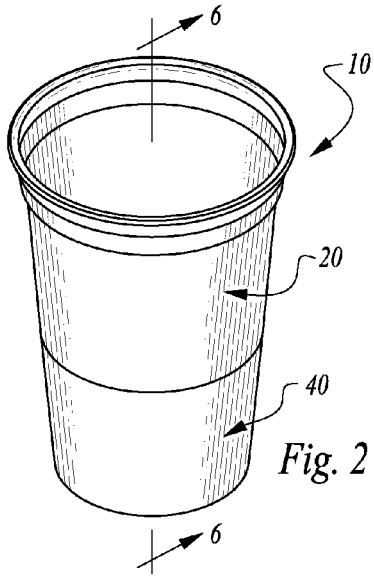
FIG. 2 is a perspective view of that which is shown in FIG. 1, but with the small cup attached to the large cup in a nested upright attachment.
Figure 3:
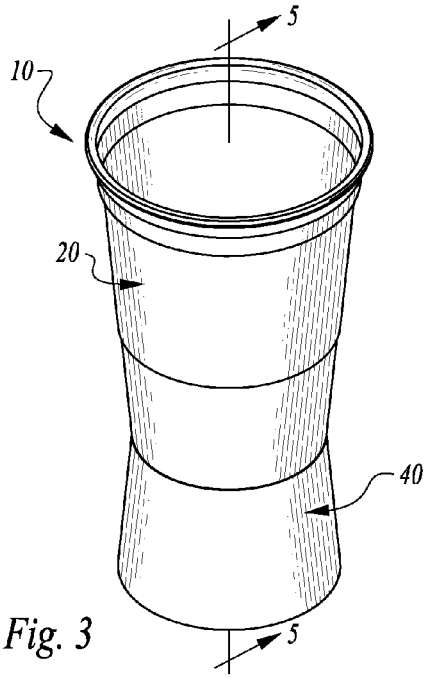
FIG. 3 is a perspective view of that which is shown in FIG. 1, but with the small cup inverted and attached to the large cup in an inverted attachment.
Figure 4:
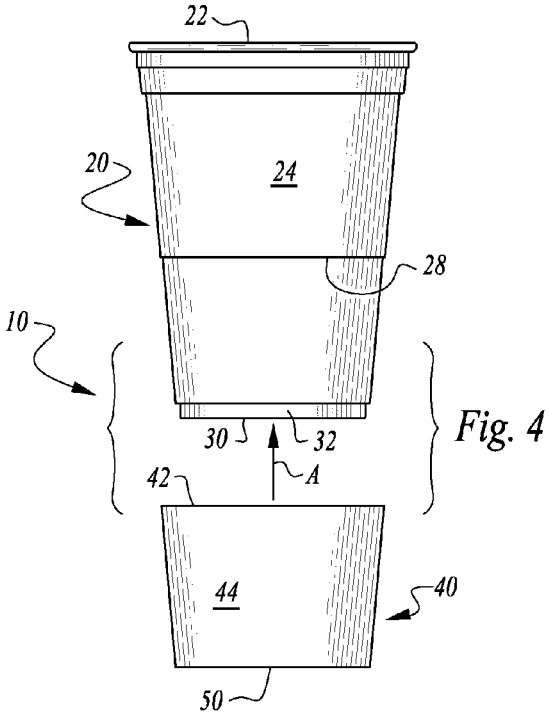
FIG. 4 is a front elevation view of the cup assembly of FIG. 1 with the small cup shown exploded away from the large cup.
Figure 5:
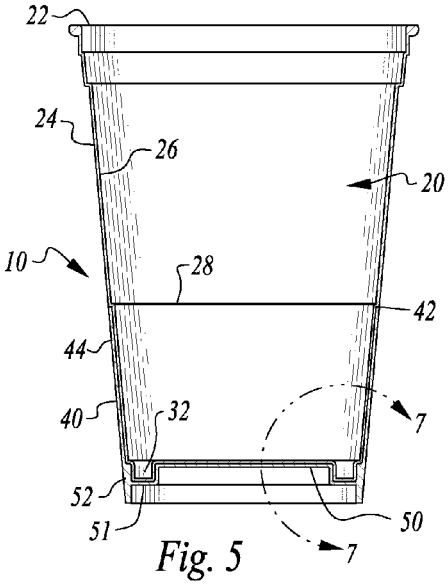
FIG. 5 is a full sectional view of that which is shown in FIG. 2.

In essence, and with particular reference to FIGS. 1-4, basic details of the assembly 10 are described according to a first embodiment. The assembly 10 includes a large cup 20 and a small cup 40. The large cup 20 has a reservoir extending from a lower end 30 up to a rim 22. The small cup 40 includes a reservoir extending up from a base 50 to a lip 42. Attachments are provided between the large cup 20 and small cup 40 including an upright attachment (FIGS. 1 and 2) and an inverted attachment (FIGS. 3 and 4). Structures on the lower end 30 of the large cup 20 and the base 50 of the small cup 40 are configured to engage together with a friction fit in two different ways to facilitate either the upright attachment or the inverted attachment.

More specifically, and with reference to FIGS. 5-8, details of the large cup 20 are described according to this first embodiment. The large cup 20 is shown in one exemplary embodiment as a tapering thin walled disposable container, such as that which would be typically formed of moldable material such as polymeric hydrocarbon (e.g. polyethylene or other plastic) material, cellulosic fiber (e.g. cardboard), styrofoam, or other generally lightweight low cost moldable materials which are substantially water tight. The large cup 20 in this embodiment includes a taper in the side wall so that the lower end 30 has a lesser diameter (or other width if not of circular cross-section) than the rim 22. The large cup 20 exhibits a radially symmetrical form about an elongate vertical central axis extending through a center of the lower end 30 and through a center of the rim 22. While this taper could vary in slope, preferably this taper exhibits a constant angle slightly away from vertical to cause the rim 22 to have a larger diameter than the lower end 30.

The sides of the large cup 20 are defined by surfaces including an outer wall 24 opposite an inner wall 26. The inner wall 26 faces inward and defines a surface of a reservoir of the large cup 20. The outer wall 24 is generally that surface which is gripped by a hand of a user when utilizing the large cup 20. If desired, upper portions of the outer wall 24, near the rim 22, can include a series of overhanging ledges to allow the large cup 20 to be more easily held by a hand of a user and avoid slipping down out of the hand of the user. The rim 22 is typically configured to be somewhat thicker than other portions of the side wall to provide a blunt surface for bringing into proximity to the mouth of a user and to facilitate removal of tightly nested stacks of large cups 20 from each other.

The large cup 20 preferably includes a step 28 in the outer wall 24 (and optionally extending into the inner wall 26 when constant wall thickness between the outer wall 24 and inner wall 26 is desired). This step 28 causes portions of the outer wall 24 above the step 28 to be slightly greater in diameter than portions of the outer wall 24 below the step 28. A difference in this diameter is preferably similar to a thickness of the side wall of the large cup 20 between the outer wall 24 and inner wall 26. In this way, when the small cup 40 has a similar wall thickness, and the small cup 40 is nested onto the large cup 20, portions of the large cup 20 above the step 28 are flush with an outside wall 44 of the small cup 40, to provide a fully integrated appearance and feel when the small cup 40 is attached to the large cup 20 in the upright attachment, with the large cup 20 nested into the small cup 40.

The lower end 30 of the large cup 20 generally acts as a pedestal to allow the large cup 20 to rest upon a horizontal surface. This lower end 30 is also configured to have structures which provide a friction fit with the small cup 40 for attachment of the large cup 20 and small cup 40 together. The lower end 30 preferably includes a foot 32 extending down from the lower end 30 to a lower surface 35. The foot 32 includes an outer surface 33 defining an outboard portion of the foot 32 and an inner surface 34 defining an inboard surface of the foot 32. The lower end 30 is thus hollowed out somewhat inboard of the inner surface 34 of the foot 32. With these various surfaces 33, 34, 35, the foot 32 has a generally annular form which is radially symmetrical and with a constant annular width and constant depth. The foot 32 exhibits a constant distance away from the centerline of the reservoir of the large cup 20.

While the foot 32 is preferably continuous as it extends circumferentially about the centerline of the large cup 20, the foot 32 could be broken into a series of separate feet spaced apart by gaps. Such multiple feet would still include the outer surface 33, inner surface 34 and lower surface 35, but these surfaces would be broken up by the gaps between the feet. As few as three feet (or two if the feet exhibit some circumferential length thereto) could conceivably be provided. Also, a number of feet larger than four feet could be provided.

Figure 6:
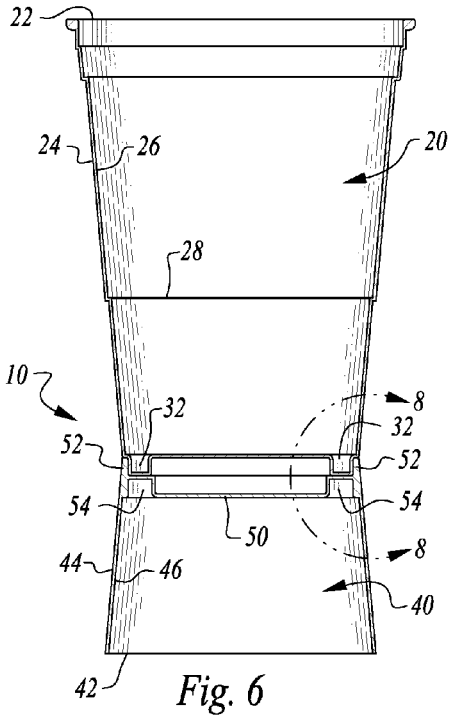
FIG. 6 is a full sectional view of that which is shown in FIG. 3.
Figure 7:
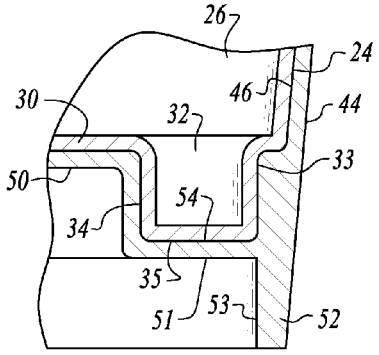
FIG. 7 is a sectional view of a portion of that which is shown in FIG. 5, taken along lines 7-7 of FIG. 5.
Figure 8:
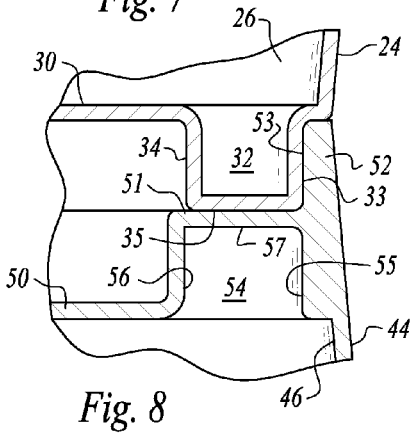
FIG. 8 is a sectional view of a portion of that which is shown in FIG. 6, taken along lines 8-8 of FIG. 6.
Figure 9:
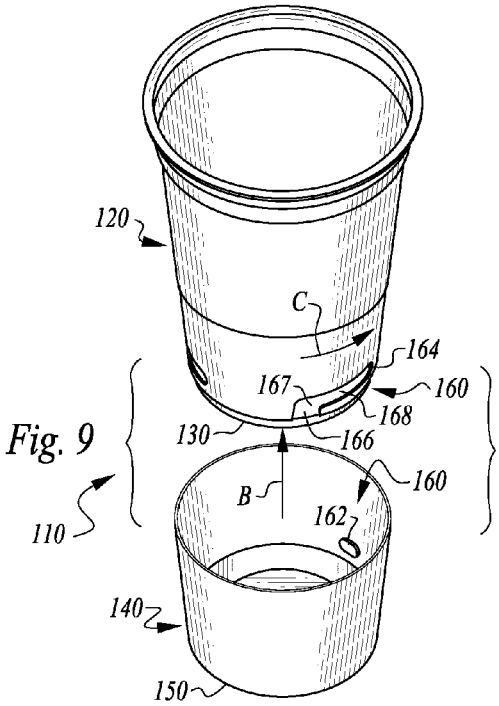
FIG. 9 is a perspective exploded view of an alternative embodiment cup assembly according to this invention with a small cup thereof spaced below a large cup thereof.
Figure 10:
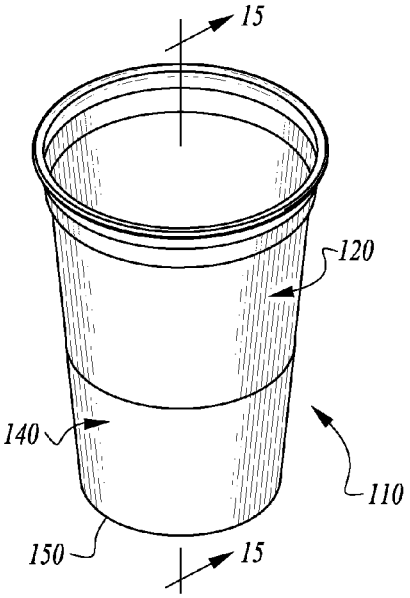
FIG. 10 is a perspective view of that which is shown in FIG. 9, but with the small cup attached to the large cup in an upright attachment.

The inside of the large cup 20 adjacent the lower end 30 typically includes an annular depression therein complemental with the foot 32, so that the foot 32 is formed by a substantially constant thickness for the material forming the large cup 20. This annular recess facilitates the nesting of multiple large cups 20 together. The foot 32 preferably has a diameter slightly less than a diameter of the outer wall 24 adjacent the lower end 30. Thus, a small ledge is defined by a distance between the outer surface 33 of the foot 32 and the outer wall 24 adjacent the lower end 30. This ledge preferably has a width similar to or slightly greater than a thickness of the side wall of the cup 20. This ledge as well as the outer surface 33 of the foot 32 facilitates seamless attachment of the small cup 40 to the large cup 20 when the small cup 40 has been inverted (FIGS. 6 and 8).

With continuing reference to FIGS. 5-8, details of the small cup 40 are described according to this first embodiment. The small cup 40 provides a second one of the pair of cups. While the small cup 40 is most typically smaller than the large cup 20 so that the reservoir of the small cup 40 does not hold as much as the large cup 20, conceivably the small cup 40 could be the same size as the large cup 20. The small cup 20 is preferably formed of a common material as that forming the large cup 20 and is manufactured utilizing similar techniques. The small cup 40 has a side wall extending up from the base 50 to the lip 42 with surfaces defined by an outside wall 44 and an inside wall 46. These walls 44, 46 taper as they extend from the base 50 up to the lip 42. Preferably, this taper is a constant angle taper, but could vary in slope. The taper exhibited by the walls 44, 46 preferably matches the taper of the outer wall 24 and inner wall 26 of the large cup 20. If the taper of the cups 20, 40 varies, preferably the taper of the small cup 40 matches a taper of the portion of the lower cup 20 closer to the lower end 30. Examples of a non-constant taper might be a parabolic taper or a spherical form. Examples of a constant taper would be a frusto-conical form or a multi-sided pyramidal form.

The outside wall 44 of the small cup 40 preferably has a diameter at the lip 42 which matches the diameter of the outer wall 24 of the large cup 20 above the step 28. The diameter of the inside wall 46 of the small cup 40 preferably matches a diameter of the outside wall 24 of the large cup 20 below the step 28. A height of the small cup 40 from the base 50 to the lip 42 is preferably similar to a distance that the step 28 of the large cup 20 is located above the lower end 30 of the large cup 20. Thus, when the small cup 40 is attached to the large cup 20 in the upright attachment with the cups 20, 40 nested together (FIGS. 2, 5 and 7), the lip 42 of the small cup 40 is adjacent the step 28 and the outside wall 44 of the small cup 40 is substantially continuous with the outer wall 24 of the large cup 20. The outside wall 44 also has measurement lines in one embodiment, which encircle the small cup 40 parallel to and above the base 50. For instance, a line midway between the base 50 and lip 42 can be labeled "one shot" and define a volume of 1.0 or 1.5 ounces, for a small cup holding about 2.0 to 3.0 ounces. The line or lines can be printed on the surface of the outside wall 44 (and/or inside wall 46), or can be formed into the wall 44, 46 such as in the form of a raised rib or groove. The line(s) can also be unlabeled or labeled with measurements, such as in ounces, milliliters or grams.

The base 50 of the small cup 40 defines a pedestal portion of the small cup 40 which can rest upon a surface. This base 50 also provides attachment structures for accomplishing both the upright attachment with the large cup 20 and the inverted attachment with the large cup 20. The base 50 includes a shelf 51 defining a horizontal surface in a plane substantially perpendicular to the centerline of the reservoir of the small cup 40. This shelf 51 extends radially inwardly from a skirt 52 which extends down (away from the lip) extending away from a perimeter of the base 50. This skirt 52 has an inside surface 53 facing inward toward the centerline of the small cup 40. The inside surface 53 of the skirt 52 has a diameter preferably matching a diameter of the outer surface 33 of the foot 32. A depth of the skirt 52 down to the shelf 51 is preferably similar to a depth of the foot 32 down to the lower surface 35. In this way, the foot 32 of the lower end 30 of the large cup 20 can press down against the inside surface 53 of the skirt 52 and against the shelf 51 to exhibit a friction fit, holding the base 50 of the small cup 40 to the lower end 30 of the large cup 20 when the small cup 40 has been inverted and the large cup 20 and small cup 40 have been brought together (FIGS. 3, 6 and 8).

The base 50 includes a recess 54 within the reservoir of the small cup 40 which extends down into the base 50. This recess 54 is preferably radially symmetrical and preferably annular in form with a constant width and a constant depth. The dimensions of this recess 54 are preferably similar to that of the foot 32 of the lower end 30 of the large cup 20. The recess 54 is thus sized so that the foot 32 can exhibit a friction fit into the recess 54. The recess 54 includes an outside 55 opposite an inside 56 which are both cylindrical in form and radially symmetrical about the centerline of the reservoir of the small cup 40. A floor 57 defines a lower end of the recess 54.

The floor 57 is sized so that it can be brought into contact with the lower surface 35 of the foot 32 with the outside 55 pressing against the outer surface 33 of the foot 32 and the inside 56 of the recess 54 pressing against the inner surface 34 of the foot 32. These surfaces exhibit sufficient friction so that the entire small cup 50 can be securely held to the lower end 30 of the large cup 20 and with the lower end 30 of the large cup 20 located within the reservoir of the small cup 40. The upright attachment is thus facilitated (FIGS. 1, 2, 4, 5 and 7).

While the recess 54 is preferably fully annular with a constant width and constant depth, the recess 54 could be broken into discreet separate recesses spaced apart by gaps in a manner similar to the way that the foot 32 could be broken into separate feet, as described in detail above. Preferably the recess 54 remains complemental with any such feet in the lower end 30 of the large cup 20 so that the feet can exhibit a friction fit into the recess 54. As an alternative, the foot 32 could be substituted with multiple separate feet but the recess 54 could still be a fully annular structure with the feet fitting into this full annular recess 54. Furthermore, the recess 54 could be substituted with separate discreet recesses spaced apart by gaps which could be provided in a greater number than the number of feet substituted for the foot 32 and large cup 20, so long as the position of any such feet in the large cup 20 can still fit into multiple ones of the recesses into which the recess 54 could conceivably be divided.

In use and operation, and with particular reference to FIGS. 1-4, the assembly 10 is usable in the following fashion. Initially, the large cup 20 and small cup 40 are provided either separate from each other (FIG. 1) or together (FIG. 2, or optionally FIG. 3). The large cup 20 and small cup 40 can be utilized separately. For instance, one beverage can be provided in the large cup 20 while a different beverage is provided in the small cup 40. As another alternative, the large cup 20 could hold a beverage while the small cup 40 holds some snack item (i.e. peanuts). When a user has consumed all of the beverage or items in the small cup 40, the small cup 40 can merely be pressed onto the lower end 30 of the large cup 20. The user thus has a hand freed up either for enjoying other food items, shaking hands, picking up other objects, etc.

If a user wishes to have a taller cup assembly, the user can invert the small cup 40 and press the base 50 of the small cup 40 against the lower end 30 of the large cup 20 to provide a taller cup assembly 10 (FIG. 3). A user could choose for decorative purposes to initially provide the assembly 10 with the small cup 40 attached to the large cup 20 in the inverted attachment to provide taller assemblies 20. Should a user wish to carry a separate beverage or food item in the small cup 40, the small cup 40 would be slid off of the large cup 20, inverted to its upright orientation (FIG. 1) and then be available for containing other beverages or other items.

When solid food items are in the small cup 40, the large cup 20 could be nested partially into the small cup 40 and the user's hand could have a grip on the small cup 40 so that both cups 20, 40 can be full and carried in one hand. If the cups 20, 40 nest with some open space remaining in the reservoir of the small cup 40, such full stacking could occur with beverages as well.

With particular reference to FIGS. 9-18, details of an alternative assembly 110 are described according to a second embodiment of this invention. The alternate assembly 110 is similar to the assembly 10 (FIGS. 1-8) except as particularly identified herein. The alternate assembly 110 includes a large cup 120 with a lower end 130 and a small cup 140 with a base 150. A fastener 160 is provided either separate from or in addition to the friction fit attachment exhibited by the assembly 10 (FIGS. 1-8). This fastener 160 includes posts 162 (FIGS. 15-17) extending inward from the small cup 140, which are spaced slightly from the base 150 and within the reservoir of the small cup 140. Slots 164 (FIGS. 9, 11 and 12) are formed in the large cup 120 near the lower end 130 and outside of the reservoir of the large cup 120.

The slots 164 preferably include a first leg 166 extending up from the lower end 130 and a second leg 168 extending radially away from a bend 167 between the first leg 166 and the second leg 168. The slots 164 preferably have a width similar to a width of the posts 162. A depth of the slots 164 is preferably similar to a height of the posts 162. While at least one post 162 is provided and at least one slot 164 is provided, preferably three posts 162 and three slots 164 are provided each radially spaced similar distances from each other. Other numbers of posts 162 and slots 164 could also be provided. When the small cup 140 is nested upon the lower end 130 of the large cup 120 in the upright attachment, the posts 162 of the fastener 160 slide into the first legs 166 of the slots 164 of the fastener (along arrow B of FIGS. 9, 12, 15 and 18). The small cup 140 is then rotated to cause the posts 164 to navigate through the bend 167 and into the second leg 168 (along arrow C of FIGS. 9, 12, 15 and 18). The fastener 160 is thus effective in attaching the small cup 140 to the large cup 120 when utilizing the upright attachment.

Figure 11:
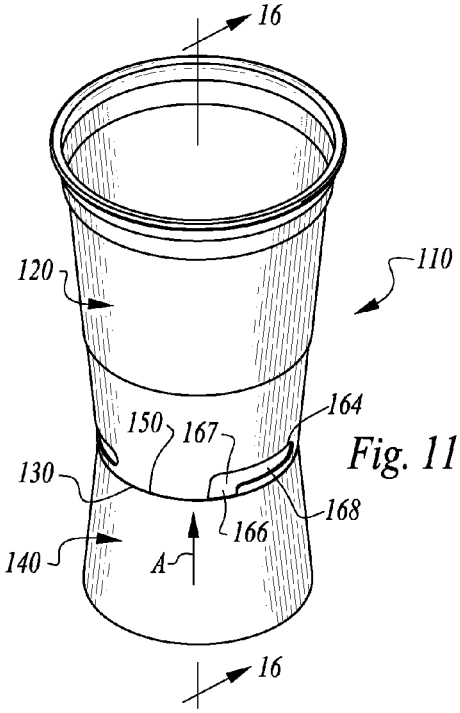
FIG. 11 is a perspective view of that which is shown in FIG. 9, but with the small cup inverted and attached to the large cup in an inverted attachment.
Figure 13:
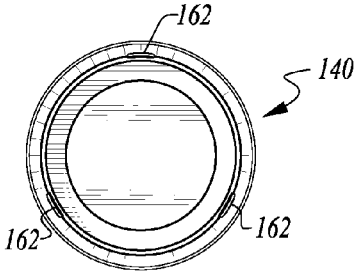
FIG. 13 is a top plan view of the small cup of FIG. 12.
Figure 12:
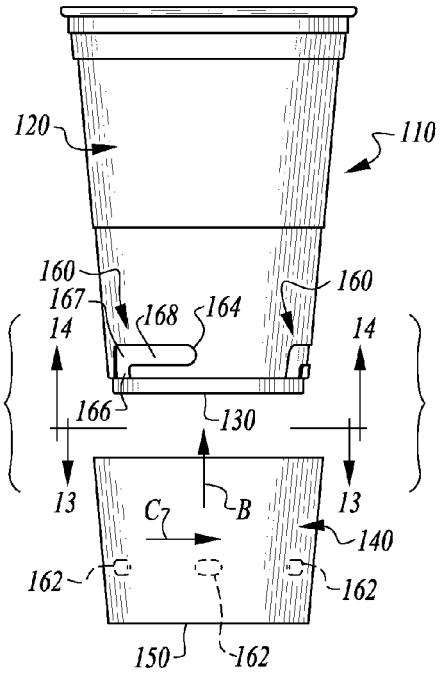
FIG. 12 is a front elevation view of that which is shown in FIG. 9, and with the small cup exploded below the large cup.
Figure 14:
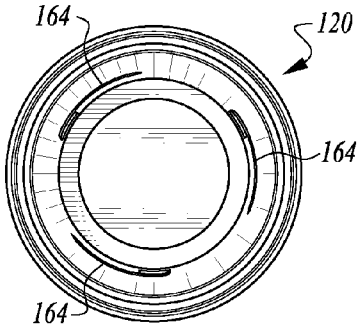
FIG. 14 is a top plan view of the large cup of FIG. 12.
Figure 15:
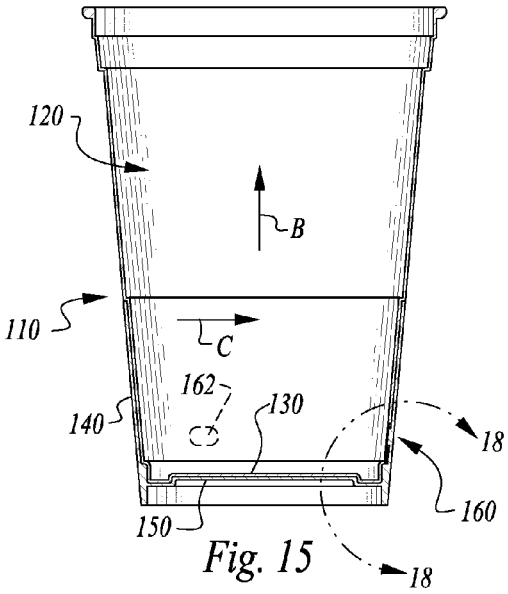
FIG. 15 is a full sectional view of that which is shown in FIG. 10.
Figure 16:
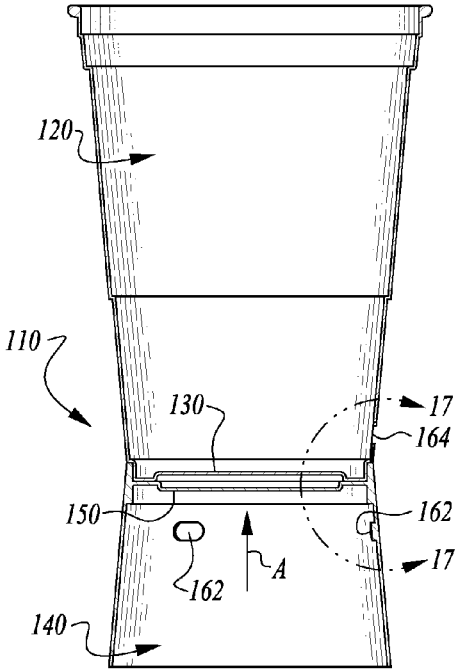
FIG. 16 is a full sectional view of that which is shown in FIG. 11.
Figure 17:
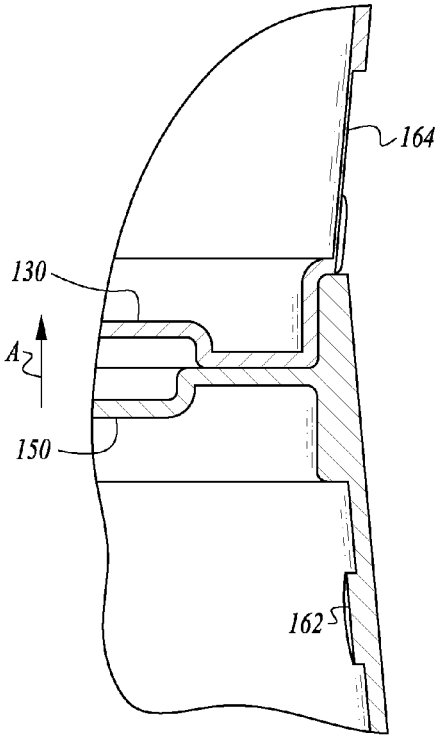
FIG. 17 is a sectional view of a portion of that which is shown in FIG. 16, taken along lines 17-17 of FIG. 16.
Figure 18:
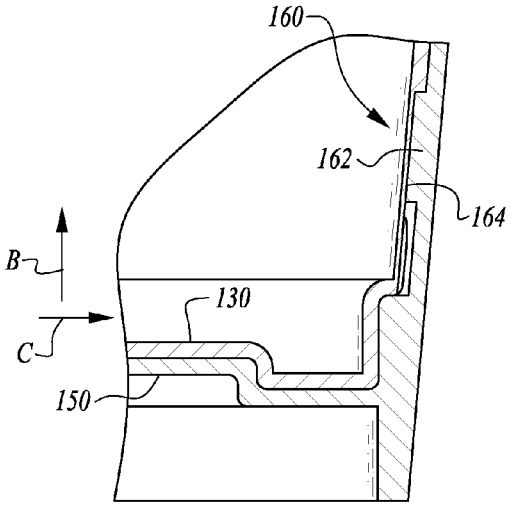
FIG. 18 is a sectional view of a portion of that which is shown in FIG. 15, taken along lines 18-18 of FIG. 15.

Other details of the small cup 140 and large cup 120 preferably match those of the cups 20, 40 of the assembly 10 (FIGS. 1-8). For instance, structures on the lower end 130 and base 150 are preferably similar to the extent needed to facilitate a friction fit when utilizing the inverted attachment (FIGS. 11, 16 and 17). Movement of the large cup 20 and small cup 140 (along arrow A of FIGS. 11, 16 and 17) can facilitate such inverted attachment. This inverted attachment motion along arrow A is similar as the motion required to facilitate inverted attachment with the cups 20, 40 of the assembly 10 (FIGS. 1-8).

This disclosure is provided to reveal a preferred embodiment of the invention and a best mode for practicing the invention. Having thus described the invention in this way, it should be apparent that various different modifications can be made to the preferred embodiment without departing from the scope and spirit of this disclosure. When structures are identified as a means to perform a function, the identification is intended to include all structures which can perform the function specified.

What is claimed is:

1. An assembly of cups, comprising in combination:
a first cup having a reservoir extending from a rim to a lower end opposite said rim;
a second cup having a reservoir extending from a lip to a base opposite said lip;
said second cup having an upright attachment to said first cup with said lip closer to said rim than said base; and
said second cup having an inverted attachment to said first cup with said lip further from said rim than said base.

2. The assembly of claim 1 wherein said first cup reservoir is larger than said second cup reservoir.

3. The assembly of claim 1 wherein said first cup and said second cup each have walls which taper defining lateral sides of said reservoirs, said walls tapering at common angles on said first cup and said second cup relative to centerlines of said reservoirs.

4. The assembly of claim 1 wherein a step is provided in an outer surface of said first cup at a location spaced from said lower end of said first cup a distance similar to a height of said second cup from said lip to said base.

5. The assembly of claim 1 wherein said upright attachment includes a portion of said lower end of said first cup outside of said first cup reservoir friction fit into a portion of said base of said second cup inside said second cup reservoir with sufficient friction to hold said second cup upon said first cup.

6. The assembly of claim 5 wherein said lower end of said first cup includes a foot extending downwardly therefrom, and wherein said base of said second cup includes a recess extending upward therefrom, said foot sized to fit within said recess with a friction fit sufficient to hold said second cup to said first cup.

7. The assembly of claim 6 wherein said foot and said recess are each radially symmetrical about a centerline of said reservoirs of said first cup and said second cup.

8. The assembly of claim 7 wherein said foot and said recess each have an annular form with a substantially constant width and a substantially constant depth such that said foot can fit within said recess in all rotational orientations of said second cup relative to said first cup about said central axis of said reservoirs of said cups.

9. The assembly of claim 1 wherein said upright attachment includes a fastener including at least one post and at least one slot, one of said post and said slot fixed to said first cup, the other of said post and said slot fixed to said second cup, said post sized to fit within said slot.

10. The assembly of claim 9 wherein said slot includes a first leg and a second leg with a bend between said first leg and said second leg, said second leg extending at least somewhat circumferentially about said centerline of said reservoirs of said first cup and said second cup.

11. The assembly of claim 1 wherein said inverted attachment includes a portion of said lower end of said first cup outside of said first cup reservoir friction fit into a portion of said base of said second cup outside of said second cup reservoir.

12. The assembly of claim 11 wherein said lower end of said first cup includes a foot extending downward therefrom, said base of said second cup including a skirt extending away from said lip with an inside surface of said skirt positioned to friction fit with an outer surface of said foot, such that when said second cup is inverted and said base of said second cup is brought into abutment with said lower end of said first cup, said foot is friction fit with said inside surface of said skirt.

13. The assembly of claim 12 wherein said base includes a shelf inboard of said skirt, said inside surface of said skirt and said shelf each being radially symmetrical about said central axis of said reservoirs of said first cup and said second cup, and said foot being radially symmetrical about said central axis of said reservoirs of said first cup and said second cup.

14. The assembly of claim 13 wherein said foot, said shelf and said inside surface of said skirt each exhibit an annular constant width and constant depth such that said foot can friction fit against said shelf and said inside surface of said skirt at all rotational orientations of said first cup relative to said second cup about said central axis of said reservoirs of said first cup and said second cup.

15. A method for attaching an assembly of cups together, including the steps of:

identifying a first cup having a reservoir extending from a rim to a lower end opposite the rim; a second cup having a reservoir extending from a lip to a base opposite the lip; the second cup having an upright attachment to the first cup with the lip closer to the rim than the base; and the second cup having an inverted attachment to the first cup with the lip further from the rim than the base;

orienting the second cup with the lip closer to the rim than the base; and connecting the base with the lower end to hold the second cup to the first cup.

16. The method of claim 15 including the further step of removing the second cup from the first cup, reorienting the second cup to have the base closer to the rim than the lip; and sliding the second cup onto the first cup with the lower end of the first cup friction fit to the base of the second cup.

17. The method of claim 16 wherein said identifying step includes the base of the second cup having a skirt extending downward therefrom with a shelf inboard of said skirt and an inside surface of said skirt extending down from said shelf, said skirt inside surface and said shelf formed complemental to a foot extending down from the lower end of the first cup; and wherein said sliding step includes sliding said foot against said inside surface of said skirt and into abutment with said shelf.

18. The method of claim 15 wherein said connecting step includes:

sliding the second cup onto the first cup with the lower end of the first cup extending into the reservoir of the second cup; and rotating the first cup and second cup relative to each other to engage a fastener to hold the first cup and second cup together.

19. The method of claim 18 wherein said identifying step includes the first cup and the second cup including a fastener therebetween, the fastener including at least one post and at least one slot, the post sized to fit within the slot, one of the posts and the slot being with the first cup, the other of the posts and the slot being with the second cup, the slot including a first leg and a second leg with a bend between the first leg and the second leg, the second leg extending at least partially circumferentially about the central axis of the reservoirs of the first cup and the second cup; and wherein said rotating step includes passing the post along the second leg of the slot.

20. A method for attaching an assembly of cups together, including the steps of:

identifying a first cup having a reservoir extending from a rim to a lower end opposite the rim; a second cup having a reservoir extending from a lip to a base opposite the lip; the second cup having an upright attachment to the first cup with the lip closer to the rim than the base; and the second cup having an inverted attachment to the first cup with the lip further from the rim than the base;

orienting the second cup with the base closer to the rim than the lip; and sliding the base into a abutment with the lower end to friction fit the second cup to the first cup.

* * * * *